United States Patent [19]

Polen

[11] 4,094,493

[45] June 13, 1978

[54] GANTRY CRANES

[75] Inventor: Karl L. Polen, Alliance, Ohio

[73] Assignee: The Alliance Machine Company, Alliance, Ohio

[21] Appl. No.: 757,059

[22] Filed: Jan. 5, 1977

Related U.S. Application Data

[62] Division of Ser. No. 637,230, Dec. 3, 1975, Pat. No. 4,027,800.

[51] Int. Cl.[2] ..... B66C 23/60

[52] U.S. Cl. ..... 254/144; 254/184; 214/15 R; 212/14

[58] Field of Search ..... 254/144, 188, 184, 185, 254/139.1, 183, 173 R; 212/13, 14, 3; 214/15 R; 114/43.5 UC

[56] References Cited

U.S. PATENT DOCUMENTS

| | | | |
|---|---|---|---|
| 1,357,429 | 11/1920 | Taylor | 254/188 |
| 2,063,912 | 12/1936 | Fitch | 254/144 |
| 2,707,053 | 4/1955 | Browning | 254/184 |
| 2,994,513 | 8/1961 | Bowerman et al. | 254/188 |
| 3,308,966 | 3/1967 | Fawell | 212/14 |
| 3,786,935 | 1/1974 | Ulazni et al. | 254/184 |
| 3,984,084 | 10/1976 | Boczek | 254/188 |

*Primary Examiner*—Stephen G. Kunin
*Assistant Examiner*—Kenneth Noland
*Attorney, Agent, or Firm*—Buell, Blenko & Ziesenheim

[57] ABSTRACT

A gantry crane and gantry crane reeving are provided having two pairs of drums on each side of said gantry, an upper sheave assembly on the gantry above each drum, each drum having a pair of independent cables reeving from the drum to said upper sheave assembly above it on the gantry, a lower relatively movable sheave assembly below each upper sheave assembly, one cable from each pair of cables passing over one sheave of the upper sheave assembly and downward around the lower sheave assembly and back over the upper sheave assembly and dead ending at the lower sheave assembly, the other cable from each pair of cables passing over a sheave of the upper sheave assembly across the gantry to the opposite upper sheave assembly on the other side of said gantry and downwardly to the lower sheave assembly on said other side and back over the said opposite upper sheave assmbly and dead ending at the said opposite lower sheave assembly.

3 Claims, 7 Drawing Figures

GANTRY CRANES

This application is a division of my co-pending application Ser. No. 637,230, filed Dec. 3, 1975 now U.S. Pat. No. 4,027,800 issued June 7, 1977.

This invention relates to LASH (lighter aboard ship) gantry cranes and particularly to a safety reeving for LASH gantry cranes.

The so-called LASH or lighter aboard ship system depends upon the use of a shipboard gantry crane for loading and unloading loaded lighters onto a ship for transport from port to port. This sytem, which was developed by Friede and Goldman, Inc., naval architects of New Orleans can handle fully loaded lighters in seas as high as eigth feet. The cranes used in this system must be able to maintain constant tension in the hoist ropes during attachment and lift. The reeving in such a crane is subject to very substantial shocks and loading and must provide the utmost safety aganist loss or failure of any part of the system. Such a system is illustrated in Weiss U.S. Pat. No. 3,428,194.

This invention provides a gantry reeving structure which is designed to prevent loss of the load when any one rope or cable fails or even if more than one rope or cable from the same drum fails.

Preferably there is provided in a gantry crane adapted to run on spaced parallel rails and having two end frames connected by an overhead frame, the improvement comprising a pair of drums in each end frame, one adjacent each end of said frame, a connection between the two drums of each pair of drums whereby said drums are rotated in unison, drive means for rotating each pair of drums, a pair of cables fixed at one end on each said drum, each of said cables passing over an overhead sheave at the top of the end frame carrying the drum, one of said cables passing across the gantry to the other end frame and around a sheave at the top thereof and through a multiplying lift sheaving of upper and lower relatively movable lifting sheaves and dead ending at one of said upper and lower sheaves, the other of said pair of cables passing over multiplying upper and lower relatively movable lift sheaving at the end frame housing, said drum and dead ending at one of said upper and lower movable lift sheaves whereby each set of lift sheaves has a double cable reeving, one from the drum at the end adjacent it and one from the drum directly opposite to it in the other end frame. Preferably the lift system includes a rectangular light beam adapted to move vertically between the end frames of the gantry and having lower lift sheaves mounted thereon at each corner with a stabilizer bar at the sheaves.

In the foregoing general description, certain objects, purposes and advantages of this invention have been set out. Other objects, purposes and advantages of this invention will be apparent from a consideration of the following description and the accompanying drawings in which.

Figure 2:
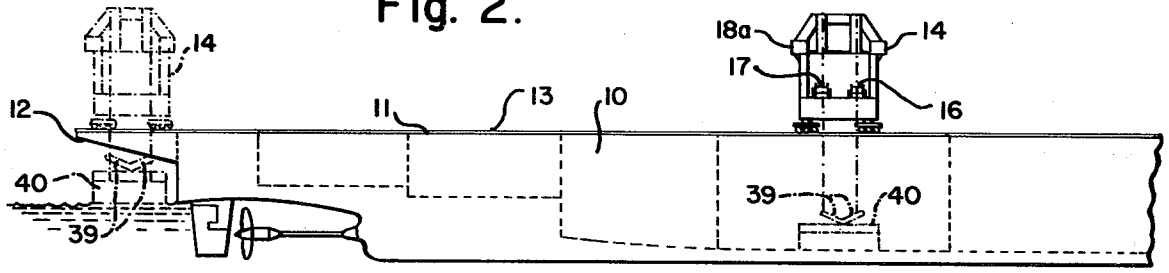
FIG. 2 is a side elevational view of the ship of FIG 1.

Referring to the drawings there is illustrated a ship hull 10 having a deck 11 and parallel cantilevered deck arms 12 extending rearwardly from the stern of the ship hull. A pair of rails 13 extends along the top of arms 12 and deck 11 to form a trackway carrying a gantry crane 14 over hatches 15 in the deck. The gantry is provided with two rope or cable take-up drums 16 and 17 on each end frame 18 and **18*a*. Each drum 16 has two independent ropes or cables 19 and 20 fixed at one end to said drum 16. Each drum 17 has two similar ropes or cables 21–22. The two ropes or cables 19 and 20 from drum 16 of end frame 18, for example, pass generally vertically upward to sheave assembly 23–30. The two ropes or cables 21 and 22 from drum 17 similarly pass vertically upwardly to sheave assembly 31–37. One of the ropes 19 from drum 16 pass over sheave 23 across the top of the gantry crane to matching sheave 31 on the opposite end frame 18*a*. This rope 19 then passes downwardly to sheave block 38 on lift arm 39 of lift beam 40. The block 38, lift arm 39 and lift beam 40 are assembled generally as illustrated by block 21, lift arm 23 and beam 25 of Weiss U.S. Pat. No. 3,428,194, the sheave block 38 of this invention being substituted for sheave block 21 of that patent. Rope 19 is then reeved around sheaves 41 and 42 of block 38, and sheaves 33 and 34 at the top of end frame 18*a* and dead ended on one end 50*a* of stabilizer 50 fixed on sheave block 38**.

Figure 5:
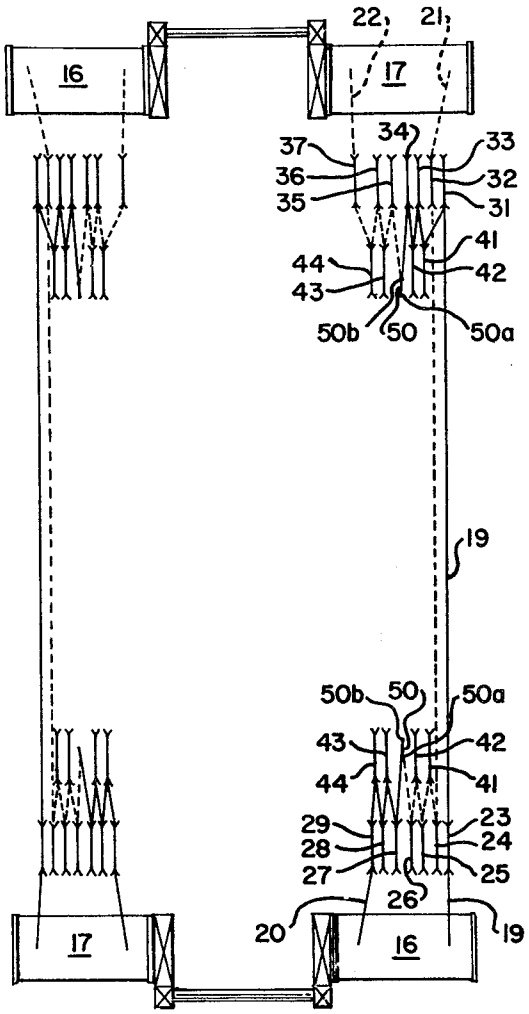
FIG. 5 is a schematic view of the cable reeving on the gantry crane according to this invention.
Figure 7:
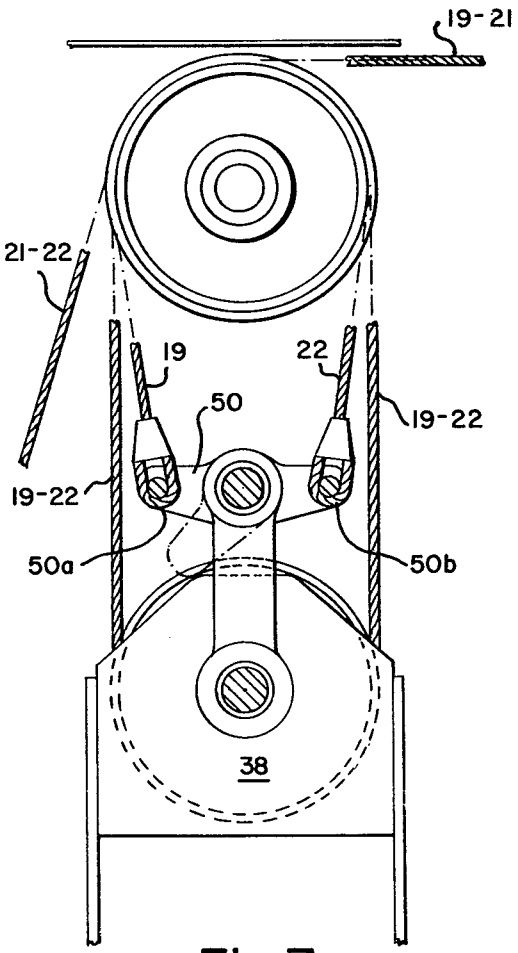
FIG. 7 is a section on the line VII—VII of FIG. 6.
Figure 6:
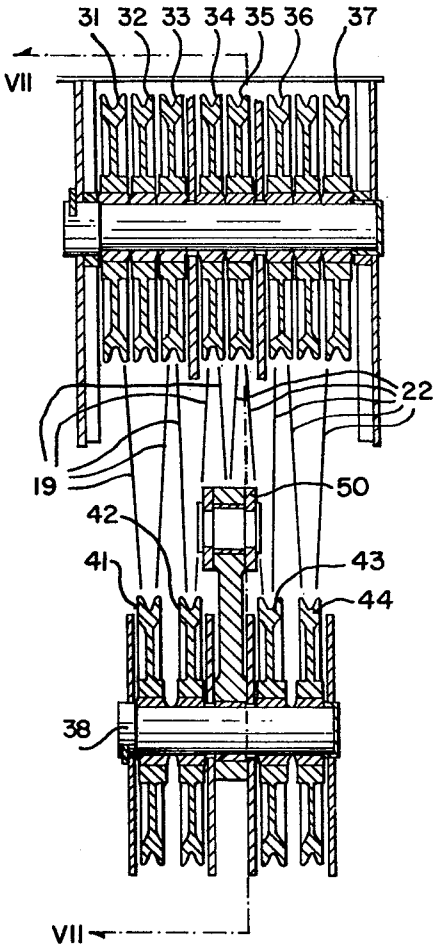
FIG. 6 is a vertical section through one set of sheaves of the gantry of this invention.

The other rope or cable 20 passes vertically upwardly over sheave 29 and is reeved around sheaves 43 and 44 of block 38 at the opposite side of lift beam 40 from rope 19 and sheaves 28 and 29 at the top of end frame 18 and dead end on end **50*b* of stabilizer bar 50. The two ropes 21 and 22 from drum 17 of end frame 18*a* pass vertically upwardly in similar manner to sheave assembly 31–37. Rope 21 passes over sheave 32 across the top of the gantry to sheave 24 on end frame 18 after which it goes downwardly around sheaves 41 and 42 of block 38 on that side, around sheaves 25 and 26 at the top of end frame 18 and is dead ended on end 50*a* of stabilizer bar 50 on the same sheave block 38 as rope 20 from drum 16 of frame 18. Rope 22 on the other hand passes upwardly over sheave 37 and is reeved around sheaves 43 and 44 of block 38, over sheaves 35 and 36 on end frame 18*a* and dead ends on end 50*b* of stabilizer bar 50 on the same sheave block 38 as rope 19 from drum 16 of end frame 18. Like cable reeving extends from the other two drums at the opposite end of the gantry as shown in FIG. 5**.

In short, there are four hoist drums with two drums 16 and 17 on the port side of the gantry and two drums 16 and 17 on the starboard side. Each drum has two independent ropes reeving from the drum to the upper sheave assembly above it, i.e. port fore drum fore upper sheave assembly and port aft drum to port aft upper sheave assembly. One rope from each drum then reeves from its upper sheave assembly to the beam sheave block 38 directly below it with a dead end at the beam equalizer bar 50. The other rope from each drum reeves from its upper sheave assembly across the gantry crane from port to starboard or from starboard to port, as the case may be, to the opposite upper sheave assembly and then to the beam sheave block 38 directly below said opposite assembly with a dead end on the beam equalizer bar 50 at that sheave block.

With the gantry crane reeved as described above, one pair of drums 16 and 17, either port or starboard could hold the lift beam 40 since any pair of drums 16 and 17 reeves to all four corners of the beam. Accordingly any one rope could fail or any pair of drums 16 and 17 could fail without loss of the load.

In the foregoing specification certain presently preferred embodiments of this invention are set out, however, it will be understood that this invention may be otherwise embodied within the scope of the following claims.

I claim:

1. A safety reeving system for gantry cranes comprising a pair of drums on each end of said gantry, an upper sheave assembly on the gantry above each drum, each drum having a pair of independent cables reeving from the drum to said upper sheave assembly above it on the gantry, a lower relatively movable sheave assembly below each upper sheave assembly, one cable from each pair of cables passing over one sheave of the upper sheave assembly and downward around the lower sheave assembly and back over the upper sheave assembly and dead ending at the lower sheave assembly, the other cable from each pair of cables passing over a sheave of the upper sheave assembly across the gantry to the opposite upper sheave assembly on the other side of said gantry and downwardly to the lower sheave assembly on said other side and back over the said opposite upper sheave assembly and dead ending at the said opposite lower sheave assembly.

2. A saftey reeving system as claimed in claim 1, wherein each lower sheave assembly is provided with a stabilizer arm pivoted intermediate its ends to said lower sheave and the two cables to said lower sheave are dead ended at opposite ends of said stabilizer arm.

3. A safety reeving system as claimed in claim 1 wherein each pair of drums has a common drive system for driving said pair in unison.

* * * * *

UNITED STATES PATENT OFFICE

CERTIFICATE OF CORRECTION

Patent No. 4,094,493 Dated June 13, 1978

Inventor(s) Karl L. Polen

It is certified that error appears in the above-identified patent and that said Letters Patent are hereby corrected as shown below:

On the title page, under "References Cited", "Ulazni" should read --Vlazny--.

Column 1, line 15, "eigth" should be --eight--.

Column 1, line 19, "aganist" should be --against--.

Column 1, line 49, "light" should be --lift--.

Figure 1:
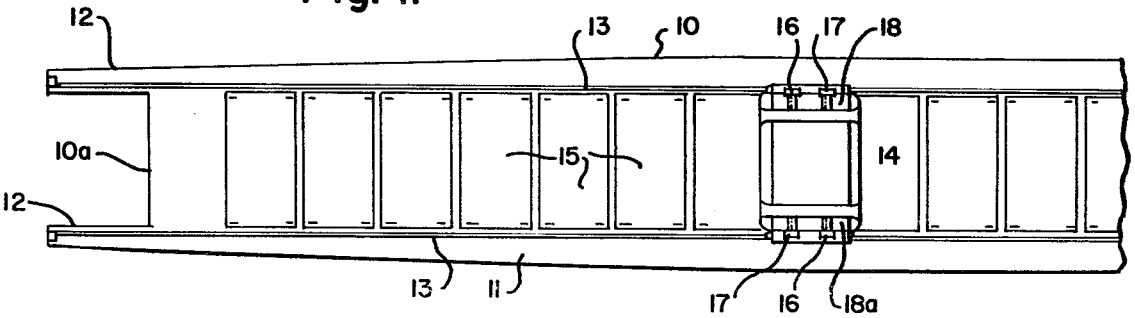
FIG. 1 is a top plan view of a ship embodying this invention.
Figure 3:
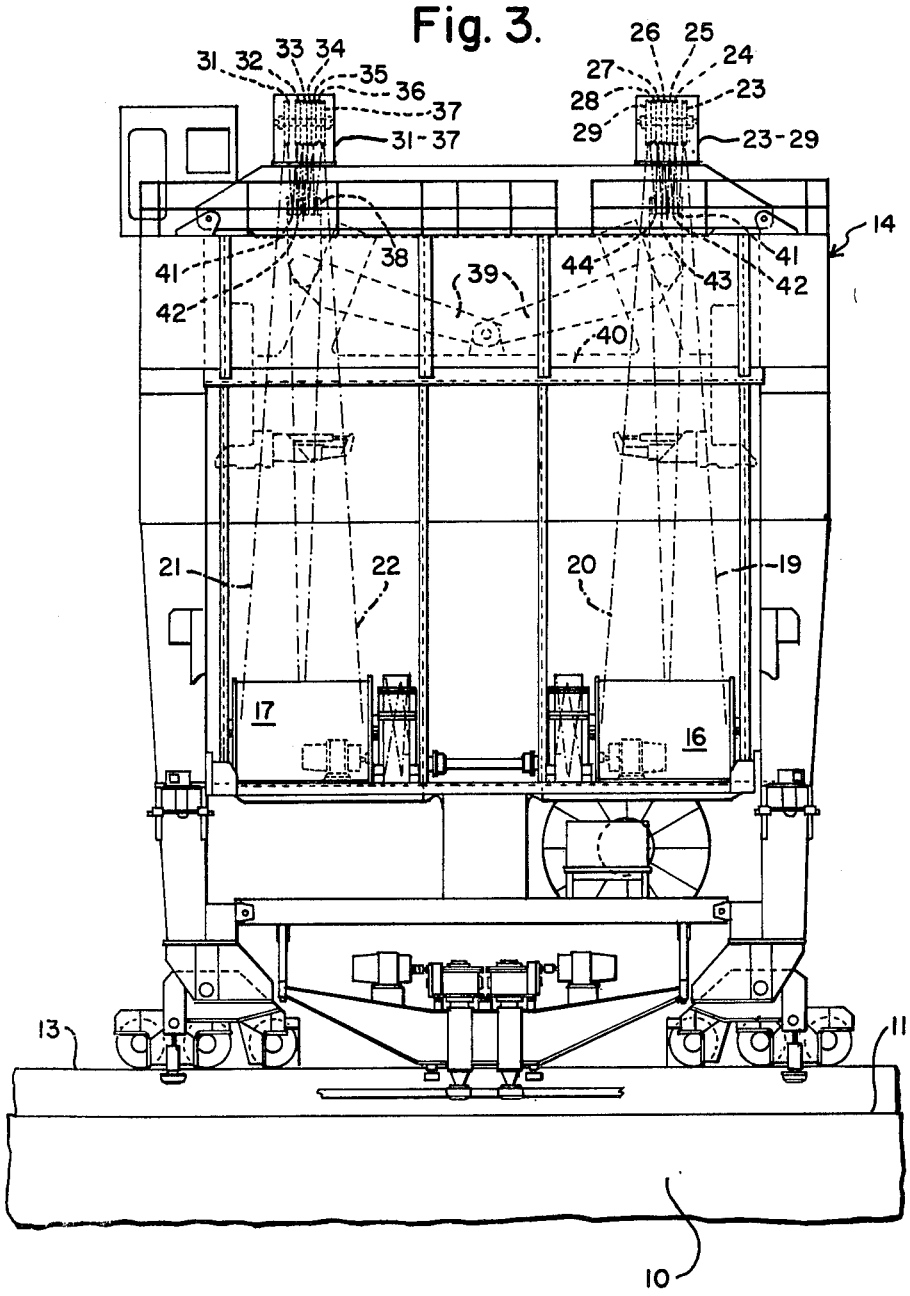
FIG. 3 is a side elevational view of the gantry crane of FIG. 1.
Figure 4:
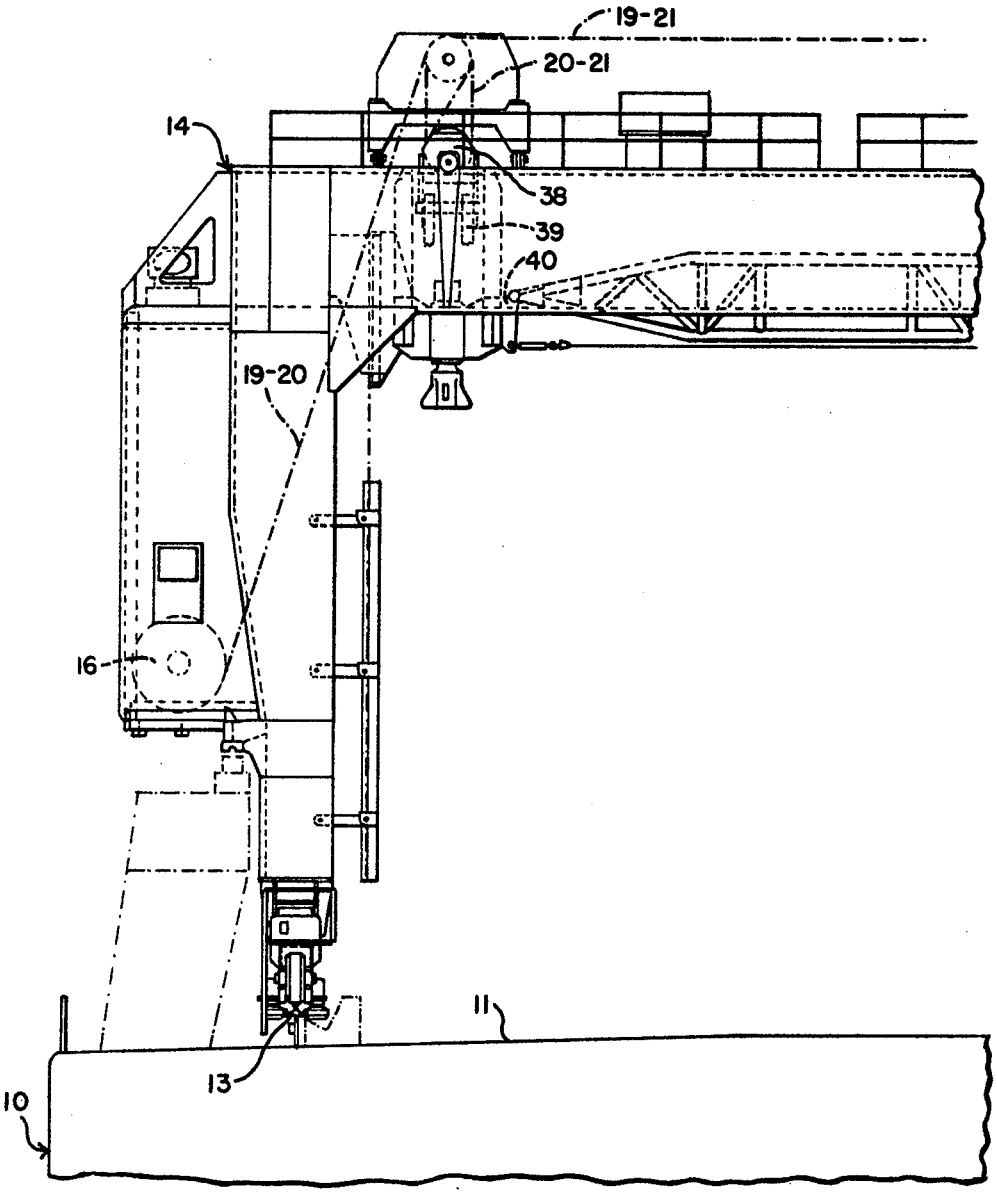
FIG. 4 is a fragmentary end elevational view of the gantry crane of FIG. 3 showing one half of the gantry.

Column 1, line 62, "FIG 1" should be --FIG. 1--.

Column 2, line 7, "extends" should be --extend--.

Column 2, line 57, after "drum" insert --to port--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*